United States Patent [19]

Ishikawa

[11] 4,258,372

[45] Mar. 24, 1981

[54] SMALL CLEARANCE RETENTION APPARATUS

[75] Inventor: Chuji Ishikawa, Kawasaki, Japan

[73] Assignee: Ricoh Company, Ltd., Japan

[21] Appl. No.: 27,818

[22] Filed: Apr. 6, 1979

[30] Foreign Application Priority Data

| | | | |
|---|---|---|---|
| Apr. 14, 1978 | [JP] | Japan | 53-43882 |
| Oct. 27, 1978 | [JP] | Japan | 53-132338 |
| Oct. 27, 1978 | [JP] | Japan | 53-132339 |
| Oct. 31, 1978 | [JP] | Japan | 53-133909 |
| Oct. 31, 1978 | [JP] | Japan | 53-133911 |
| Nov. 20, 1978 | [11] | Japan | 53-143170 |

[51] Int. Cl.[3] ..... G01D 15/06

[52] U.S. Cl. ..... 346/153.1; 346/155; 355/3 DD

[58] Field of Search ..... 355/3 R, 3 DD, 3 TR; 346/101, 139 C, 153, 155

[56] References Cited

U.S. PATENT DOCUMENTS

| | | | |
|---|---|---|---|
| 3,601,092 | 8/1971 | Satomi | 118/661 |
| 3,951,542 | 4/1976 | Ito et al. | 355/3 DD X |
| 4,052,959 | 10/1977 | Hayashi et al. | 355/10 X |
| 4,137,537 | 1/1979 | Takahashi et al. | 346/153 X |

*Primary Examiner*—Fred L. Braun

*Attorney, Agent, or Firm*—McGlew and Tuttle

[57] ABSTRACT

The small clearance retention apparatus comprises a cylindrical rotating member, a recording or otherwise cooperating member disposed in close proximity with the cylindrical rotating member so as to maintain a small clearance, in the direction parallel to a generating line of the cylindrical rotating member, between the outer peripheral surface of the cylindrical rotating member and the recording member, and a spacer for maintaining the small clearance constant. The spacer is formed by rollers supported rotatably by a support member other than the cylindrical rotating member and the recording member and the peripheral surface of the rollers are in pressure contact with the peripheral surface at an end portion of the cylindrical rotating member, while the recording member is in pressure contact with support structure of the rollers.

32 Claims, 24 Drawing Figures

SMALL CLEARANCE RETENTION APPARATUS

BACKGROUND OF THE INVENTION

The present invention relates to small clearance retention apparatus, and more particularly to a small clearance retention apparatus capable of retaining uniformly a small clearance between cylindrical rotating member and a specific or cooperating member, such as the clearance between a donor drum and a recording electrode, extending over the required full length of such members.

As an example of an apparatus which requires that the small clearance between a cylindrical rotating member and a specific member be maintained constant, there is an electrostatic recording apparatus employing a drum and a recording electrode facing the drum. In the apparatus, the small clearance between the drum and the recording electrode has to remain constant.

In the electrostatic recording apparatus, there are two types, namely a direct type and a transfer type.

In the direct type electrostatic recording apparatus, there are disposed a donor drum whose surface is uniformly covered with conductive magnetic toner and which is rotated at a predetermined constant speed, and a recording electrode in which numerous recording styluses are aligned in the axial direction of the donor drum, with a predetermined clearance between the donor drum and the recording electrode, and a recording paper is caused to pass between the recording electrode and the donor drum while applying image information signals from a signal generating apparatus to the recording electrode. In accordance with the magnitude of the applied voltage, toner on the drum is attracted to the recording sheet, so that an image is reproduced. In such an apparatus, when the above-mentioned clearance is too small, the recording sheet is brought into contact with the toner on the drum, causing toner deposition on the background of the reproduced image. On the other hand, when the clearance is too great, the electric field in the clearance becomes so weak that the image density of the reproduced image becomes low. Accordingly, when the clearance is changed during operation, the image density of the reproduced image becomes uneven. Therefore, the clearance has to be always maintained constant.

In the case of a transfer type electrostatic recording apparatus, a dielectric drum is used as the drum, and in operation, the surface of the dielectric drum is charged uniformly in advance and the charge is then neutralized selectively by applying charges thereto in accordance with the image signals from the recording electrode or a latent electrostatic image is formed by applying charges to the surface of the dielectric drum from the recording electrode in accordance with the image signals and the thus formed latent electrostatic image is developed with toner and the toner image is then transferred to the recording sheet.

In the conventional clearance retention apparatus for use in such recording apparatus, spacers, such as rollers, are disposed on the opposite sides of the recording electrode in the axial direction of the drum, and the spacers are brought into contact with the outer peripheral surface of the drum, with the outer peripheral surface of the drum set as a standard surface, whereby the clearance is maintained. In the case where the conventional spacers are fixed to the opposite ends of the recording electrode or disposed rotatable, there is a danger that a perdetermined clearance cannot be obtained uniformly over the necessary longitudinal length thereof due to the eccentricity of the drum or some other errors which may occur during the production thereof. Furthermore, it is extremely difficult to adjust the clearance.

In case no foreign material, such as powder toner, exists in the contact area between the spacers and the drum, the clearance may be maintained constant. However, in the case of the above-mentioned direct type recording apparatus, since the donor drum bears the powder toner on the whole peripheral surface thereof, the powder toner may be scattered and the scattered toner is apt to be deposited on the contact area between the spacer members and the donor drum. When the toner is deposited on the contact area between the spacers and the donor drum, toner is caused to adhere to the spacers or to the outer surface of the donor drum by the pressing force between the spacers and the donor drum. In this condition, the surface of the spacers or that of the donor drum becomes uneven, and in particular, a complete cylindrical surface cannot be obtained on the outer peripheral surface of the donor drum, resulting in that the clearance cannot be maintained constant or the outer peripheral surface of the donor drum is scratched.

In the case where the spacers are rollers which rotate along the outer peripheral surface of the donor drum, the powder toner is scattered, entering the bearing portions of the rollers. This hinders the correct rotation of the rollers and causes abrasion of the bearing portions and abnormal noises during the rotation of the rollers.

SUMMARY OF THE INVENTION

It is therefore a first object of the present invention to provide a small clearance retention apparatus capable of maintaining a small clearance between a cylindrical rotating member and a specific or cooperating member, such as a clearance between a donor drum and a recording electrode uniformly, over a required full length thereof.

A second object of the present invention is to provide a small clearance retention apparatus capable of adjusting easily the clearance size between a cylindrical rotating member and a specific member.

A third object of the present invention is to provide a small clearance retention apparatus constructed so that foreign materials, such as powder toner, are not scattered and deposited on the contact area between a spacer and a cylindrical rotating member when the clearance between the cylindrical rotating member and a specific member is maintained by use of the spacer.

The first object of the present invention can be attained by a small clearance retention apparatus comprising a pressure application means capable of giving a specific member disposed movably in the detachable direction from a cylindrical rotating member a movement bias enabling the specific member to come close to the cylindrical rotating member, spacers comprising rollers capable of coming in contact with the outer peripheral surface on the opposite end portions of the cylindrical rotating member, and a pair of spacer support means for supporting the spacers rotatably and bringing the portion except the rollers into contact with a part of the specific member.

The second object of the present invention can be attained by a small clearance retention apparatus comprising a pressure application means capable of giving a specific member disposed movably in the detachable direction from a cylindrical rotating member a movement bias enabling the specific member to come close to the cylindrical rotating member, a pair of spacers comprising rollers which can be brought into contact with the outer peripheral surface of the cylindrical rotating member, a pair of spacer support means for supporting the spacers rotatably, with the portion except the rollers brought into contact with a flat portion of the specific member which faces the cylindrical rotating member, and a pair of spacer moving means capable of adjusting the small clearance between the specific member and the cylindrical rotating member by moving the spacers along the outer peripheral surface of the cylindrical rotating member.

The third object of the present invention can be attained by an apparatus in which the outer peripheral surface of the cylindrical rotating member is divided into an effective image formation area in the central portion thereof and guide surfaces on the opposite end portion of the central portion and a circular groove is formed in the boundary portion between the effective image formation area and the guide surface, or by an apparatus in which the above-mentioned circular groove constitutes a labyrinth, or by an apparatus in which a toner reomval means is at the guide surface.

According to the present invention, since the spacers are disposed without being fixed to either the specific member or the cylindrical rotating member, the clearance between the specific member and the cylindrical rotating member can be maintained constant without being affected by the eccentricity of the cylindrical rotating member and that of the spacers.

Furthermore, the spacers can be moved separately on the opposite sides of the specific member, so that clearance between the specific member and the cylindrical rotating member can be adjusted easily and a lack of parallelism between the two members in the axial direction of the cylindrical rotating member can be corrected easily.

Furthermore, according to the present invention, the outer peripheral surface of the cylindrical rotating member is divided into a central portion and the opposite end portions and the central portion is used as an effective image formation area and the opposite end portions are used as guide surfaces for the spacers and a circular groove is formed between the effective image formation area and the respective guide surfaces. Therefore, by forming a labyrinth in each of the circular grooves, the entering of powder toner into the guide surfaces from the effective image formation area can be prevented and in particular, the variation of the clearance between the specific member and the cylindrical rotating member, which may be caused by such entering of toner, can be prevented.

Furthermore, by providing a toner removing means on the guide surfaces, the substantial increase of the diameter of the guide surface and that of the spacers when the spacers are constructed of rollers can be held small, so that the small clearance can be always maintained in a stable manner.

BRIEF DESCRIPTION OF THE DRAWINGS

For a better understanding of the invention as well as other objects and further features thereof, reference is had to the following detailed description of the invention to be read in connection with the accompanying drawings, wherein.

DETAILED DESCRIPTION OF THE PREFERRED EMBODIMENTS

Based on a direct recording apparatus to which the present invention is applied, an embodiment of a small clearance retention apparatus according to the present invention will be explained.

Figure 1:
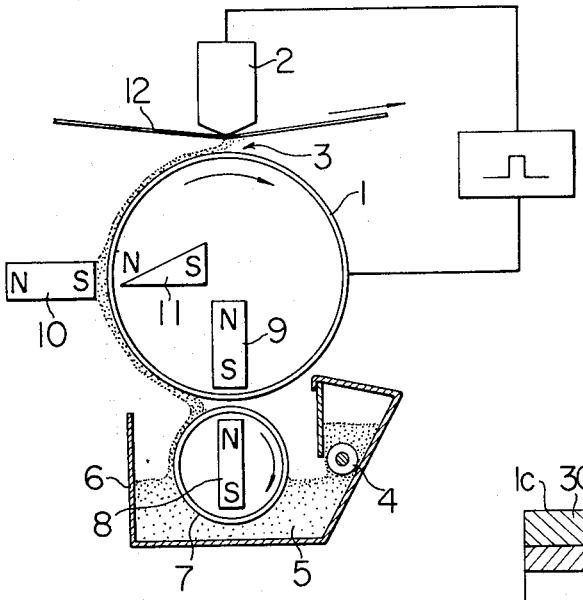
FIG. 1 is a diagrammatic view of a direct recording apparatus which is suitable for use with the present invention.
Figure 6:
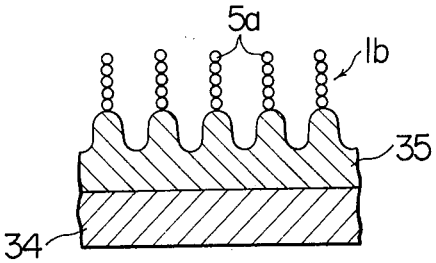
FIG. 6 is a partially enlarged sectional view of a donor drum for explaining the surface of the donor drum.

Referring to FIG. 1, there is shown the general construction of a direct recording apparatus. In FIG. 1, reference numeral 1 represents a cylindrical rotating donor drum. In FIG. 1, above the donor drum 1, there is disposed a recording electrode 2, which serves as a specific or cooperating member, facing the donor drum 1 with a predetermined clearance between the recording electrode 2 and the outer peripheral surface of the donor drum 1. The donor drum comprises, as shown magnified in FIG. 6, a non-magnetic cylinder 34, for instance, made of aluminum or brass and a magnetic layer 35, for instance, made of nickel, formed on the outer peripheral surface of the non-magnetic cylinder 34. The non-magnetic cylinder 34 is processed so that the outer peripheral surface thereof is microscopically undulating. The recording electrode 2 is extended above a generating line of the donor drum 2, and in the recording electrode 2, there are embedded numerous stylus electrodes aligned in the direction of the generating line, to which signals corresponding to image information are selectively applied.

Under the donor drum 1, there is disposed a toner container 6 provided with a toner replenishment apparatus 4. The toner container 6 holds powder-like electroconductive magnetic toner 5. Inside the toner container 6, there is disposed a non-magnetic sleeve element 7, which is disposed with a predetermined small clearance with respect to the outer peripheral surface of the donor drum 1, and which is rotated about the central axis of the sleeve element 7. Inside the sleeve element 7, there is disposed a magnet element 8, whose one pair of magnetic poles is directed towards the outer peripheral surface of the donor drum 1, with the sleeve element 7 therebetween. Furthermore, inside the donor drum 1, there is disposed a magnet element 9 facing the magnet element 8. Downstream of the donor drum 1 in view of the rotating direction thereof, there are disposed magnet elements 10 and 11 facing each other, with the magnet element 10 outside the donor drum 1 and the magnet element 11 inside the donor drum 1.

A recording sheet 12 is placed so as to pass through the clearance 3 between the donor drum 1 and the recording electrode 2, and the recording sheet 12 is transported in the direction of the arrow in contact with a front portion of the recording electrode 2. The toner 5 placed in the toner container 6, deposited on the outer peripheral surface of the sleeve element 7, is transported in the direction of the outer peripheral surface of the donor drum 1 by the sleeve element 7 which is rotated in the direction of the arrow and by the magnet element 8 disposed in the sleeve element 7. The toner 5 is transported from the surface of the sleeve element 7 to the peripheral surface of the donor drum 1 by the magnetic element 9 and the toner 5 is held on the peripheral surface of the donor drum 1 by the residual magnetic force of the donor drum 1 and is transported. As the donor drum 1 is rotated, the toner 5 held on the outer peripheral surface of the donor drum 1 is brought between the magnetic elements 10 and 11. When the toner 5 held on the outer peripheral surface of the donor drum 1 is brought between the magnet elements 10 and 11 as the donor drum 1 is rotated, the toner 5 so far desposited at random on the peripheral surface of the donor drum 1 is aligned along the line of magnetic force of the magnet elements 10 and 11, so that the so-called towers 5*a* are formed (refer to FIG. 6). The towers 5*a* are not in contact with the recording sheet 12. The donor drum 1 is rotated in the same direction as that of the transporting direction of the recording sheet 12 and at the same peripheral speed as the transporting speed of the recording sheet 12 or at a higher speed than the transporting speed of the recording sheet 12. When signals corresponding to an image information is applied to the recording electrode 2 under this condition, an electric field is locally formed in the direction of the thickness of the recording sheet 12 so as to pass therethrough, corresponding to the voltage of the signals. By the action of the electric field and electrostatic induction, electric charges are injected into the toner deposited on the peripheral surface of the donor drum 1, so that the toner 5 is selectively transferred to the surface of the recording sheet 12 in accordance with the applied signals by the mutual action of the injected charges and the electric field. A toner image corresponding to the image information is formed on the surface of the recording sheet 12 and the toner image is fixed by an appropriate means to make it a permanent image.

Figure 2:
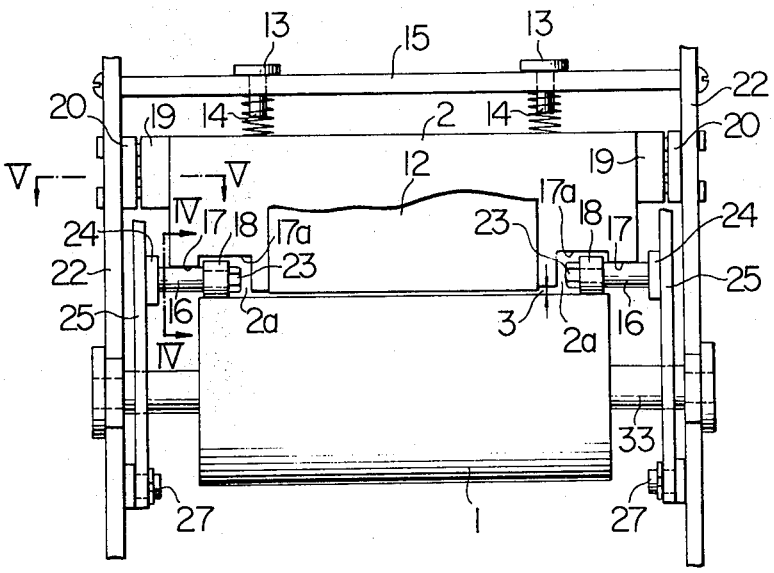
FIG. 2 is a schematic front view of a direct recording apparatus in which the present invention is employed.

Referring to FIG. 2, the recording electrode 2 is urged to come near the donor drum 1 by pressure means in the form, for example, of compressed springs 14 and 14 which are guided by guide pins 13 and 13 fixed to a stationary base plate 15. At the opposite ends of the recording electrode 2, in the end portion of the recording electrode 2 close to the donor drum 1, there are formed notches 2*a* and 2*a*. The end portions 17 and 17 of the notches 2*a* and 2*a* are finished particularly smoothly, and form a smooth surface normal to the direction in which the recording electrode 2 comes close to the donor drum 1. The notches 2*a* and 2*a* have the surfaces 17*a* and 17*a* which are gouged more deeply than the plain surface 17 and 17, which serve as contact portions, so that rollers 18 and 18, which serve as spacermembers, can be accommodated in the portion of the surfaces 17*a* and 17*a*.

Figure 5:
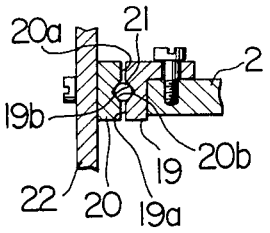
FIG. 5 is a sectional view of an example of a recording electrode support apparatus taken on line V-V in FIG. 2.

On the opposite sides of the recording electrode 2, there is disposed a recording electrode support apparatus which acts as cooperating member support means, so that the recording electrode 2 can always be brought into close proximity with the central axis of the donor drum 1 correctly. The recording electrode support apparatus or means is, for example, a linear ball bearing apparatus comprising a first support plate 19, a second support plate 20 and a chain ball 21 (refer to FIG. 5). The first support plate 19 is fixed to the recording electrode 2 and the second support plate 20 is fixed to a side plate 22. In the facing surfaces of the support plate 19 and the support plate 20, namely a surface 19*a* and a surface 20*a*, there are respectively formed V-shaped grooves for allowing the chain ball 21 to rotate freely therebetween.

The rollers 18 and 18, which are in contact with the outer peripheral surface of the donor drum 1 at the opposite end portions thereof, are incorporated in the space of the notches 2*a* and 2*a*, and support shafts 16 and 16, which are roller or spacer support means, are in contact with the plain surfaces 17 and 17 of the recording electrode 2.

Figure 3:
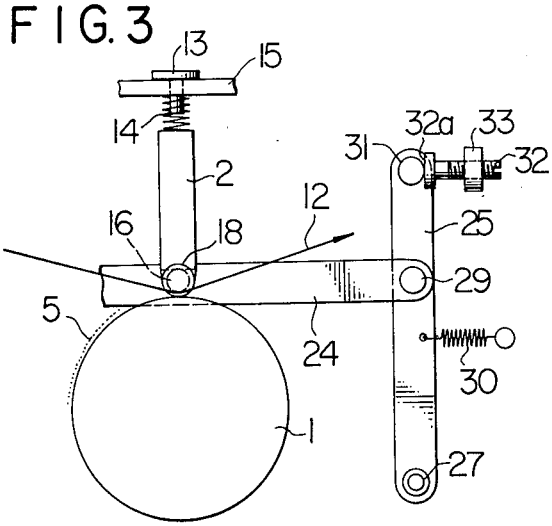
FIG. 3 is a schematic side view showing the construction of a small clearance adjustment means according to the present invention.

The support shafts 16 and 16 are disposed in parallel to the longitudinal direction of the recording electrode 2. On one end of each of the shafts 16 and 16, directing at the inner side of the recording electrode 2, there is rotatably mounted each of the rollers 18 and 18, each of which is prevented from detaching from each of the shafts 16 and 16 by nuts 23 and 23. Referring to FIG. 3, the roller moving or separate means, which serves as the spacer moving means, comprises mainly movement plates 24 and 24, and adjustment plates 25 and 25. The roller moving means will now be explained in more detail. In the following explanation, only one side of the roller moving means will be explained.

A base end portion of the shaft 16 is fixed to an approximately central portion of the movement plate 24 which is disposed movably in the horizontal direction. The movement plate 24 is a long and narrow member and one end of the movement plate 24 is pivotally connected to a central portion of the adjustment plate 25 by a pin 29. The adjustment plate 25 is disposed vertically and the lower end portion of the adjustment plate 25 is pivotally connected to the side plate 22 by a pin 27 and in the upper end portion of the adjustment plate 25, a pin 31 is embedded. The adjustment plate 25 is biased to the right by a spring 30 in FIG. 3, and the upper end pin 31 is in contact with a plain headed portion 32*a* of an adjustment screw 32. The adjustment screw 32 is screwed into a screw hole of a stationary base plate 33.

Figure 4:
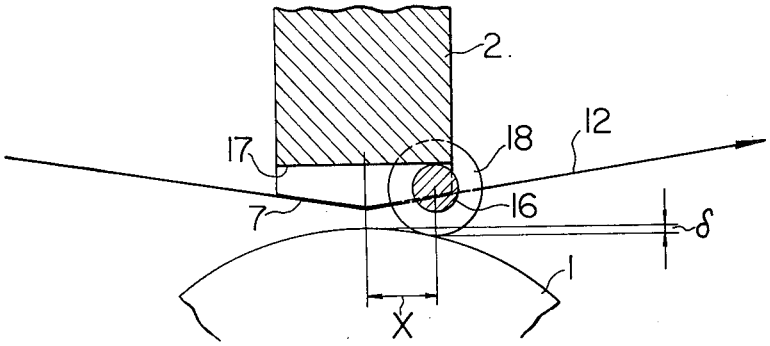
FIG. 4 is an enlarged and simplified sectional view showing the configuration of a recording electrode and a spacer and a donor drum.

By the above-mentioned construction, the recording electrode 2 is always positioned correctly with respect to the central axis of the donor drum 1, and the force of springs 14 and 14 applied to the recording electrode 2 is received by the shafts 16 and 16 through the oppositely disposed plain surfaces 17 and 17 is further applied to the outer peripheral surface of the donor drum 1 through the rollers 18 and 18 disposed at the top portions of the shafts 16 and 16. Accordingly, the recording electrode 2 follows the donor drum 1 and the clearance 3 can be kept constant irrespective of the eccentricity of the donor drum 1. Furthermore, referring to FIGS. 3 and 4, by rotating the adjustment screw 32 and screwing the head portion 32*a* of the screw 32, the pin 31 is displaced. The displacement of the pin 31 is reduced and the shaft 16 is moved equivalent to the displacement of the pin 29. Therefore, the roller 18 attached to the shaft 16 is moved along the peripheral surface of the donor drum 1, for example, by the distance X in FIG. 4. At this time, the shaft 16 is not rotated and is moved horizontally by the distance X while in contact with the plain surface 17 of the recording electrode 2. The horizontal movement distance X of the shaft 16 appears in the form of a change $\delta$ of the size of clearance in the vertical direction. In this case, the change ratios of X and $\delta$ increase as the shaft 16 is moved away from the line connecting the central axis of the donor drum 1 and that of the recording electrode 2. However, the change ratios are extremely small in the central area and in that area, the adjustment of small displacement becomes easy and accurate.

In this case, there is danger that pressure is always applied to the plain surfaces 17 and 17 of the recording electrode 2 and the plain surfaces 17 and 17 are brought into contact with the shafts 16 and 16, which may cause abrasion of the plain surfaces 17 and 17. Therefore, it is preferable to use an abrasion resistant member as the plain surfaces 17 and 17 or to perform surface hardening process.

Since the rollers 18 and 18 are in contact with the opposite end portions of the donor drum 1, measurement has to be taken with respect to the contact area of the roller 18 and 18 and the opposite end portion of the donor drum 1.

Figure 7:
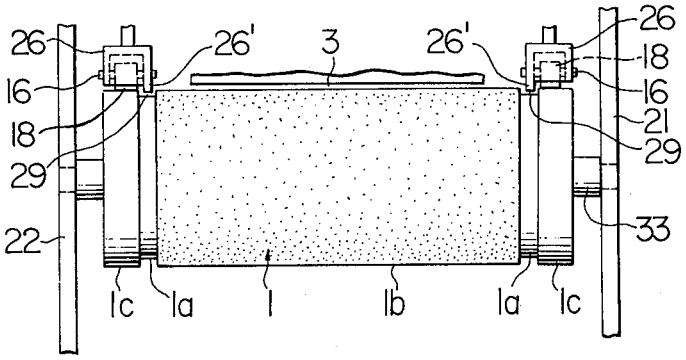
FIG. 7 is a front view of a donor drum having guide surfaces with which spacers are in contact for maintaining a small clearance in a stable manner, an effective image formation area for forming image therein, and circular grooves formed between the effective image formation area and the guide surfaces.

Referring to FIG. 7, the donor drum 1 is rotatably supported on the shaft 33 between the side plates 22 and 22, which are disposed in the opposite sides, respectively. The donor drum 1 has a circular groove 1*a* in each of the opposite end portions of the donor drum 1. The space between the circular grooves 1*a* and 1*a* constitutes an effective image formation area 1*b*, where toner is practically held. The area from each of the circular grooves 1*a* to each drum side end portion constitutes a guide surface 1*c*. The effective image formation area 1*b* is processed so as to have minutely undulated surface by electro-forming after accurate grinding finish (refer to FIG. 6). The guide surface 1*c* is subjected to hardening processing, such as hard alumite processing and hard chrome processing, after highly accurate grinding finish, so that the surface hardness of the guide surface 1*c* is increased.

The roller 18 is rotatably supported on a roller bracket 26 through the shaft 16. The roller bracket 26 is supported by the movement plate (whose reference numeral is 24 in FIGS. 2 and 3).

Each of the rollers 18 is brought into pressure contact with the guide surface 1*c* of the donor drum 1 and is rotated on the guide surface 1*c* in accordance with the rotation of the donor drum 1, so that the clearance 3 between the outer peripheral surface of the donor drum 1 and the recording electrode 2 is kept constant with the peripheral surface of the donor drum 1 set as a standard surface.

Since the surface of the effective image formation area 1*b* is processed so as to be minutely undulated, electric charges are concentrated in the convex portions of the minutely undulated surface, so that toner is aligned regularly, reducing scattering of the toner onto the recording sheet 12. Furthermore, since the guide surface 1*c* of the donor drum 1 has been subjected to hardening processing, it is not abraded easily, so that the clearance 3 can be maintained substantially constant for a long period of time. Furthermore, the circular groove 1*a* formed between the effective image formation area 1*a* and the guide surface 1*c* serves to prevent toner deposited on the effective image information area 1*b* from entering the guide surface 1*c*. The circular groove 1*a* also serves as a divisional zone when the surface treatment of the donor drum 1 is conducted, which makes the surface treatment easy. The surface treatment of the effective image formation area 1*b* is conducted by electro-forming, while the surface treatment of the guide surface 1*c* is conducted by such a processing as hard alumite processing and hard chrome processing. The two portions are processed in the entirely different manners. The circular groove 1*c* serves to prevent one surface treatment method from giving adverse effects to another surface treatment method, and both surface treatment methods can be conducted easily by the circular groove 1*c*.

Figure 8:
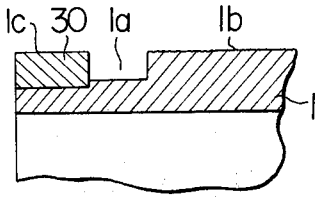
FIG. 8 is a partially enlarged sectional view of another example of the donor drum shown in FIG. 7.

In the above-mentioned embodiment, the hard layer of the surface of the guide surface 1*c* of the donor drum 1 is obtained by the hardening processing. However, the present invention is not limited to such processing. As shown in FIG. 8, the guide surface 1*c* can be constructed of a hard sleeve 30 which has been processed hard and which is attached to the side end portion of the donor drum 1.

Figure 9:
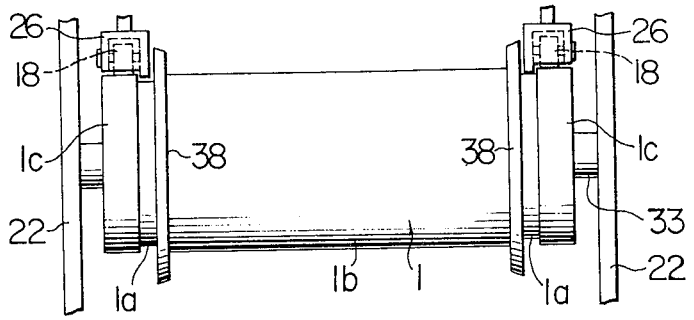
FIG. 9 is a front view of an example of a donor drum in which a flange member is disposed in the circular grooves.
Figure 10:
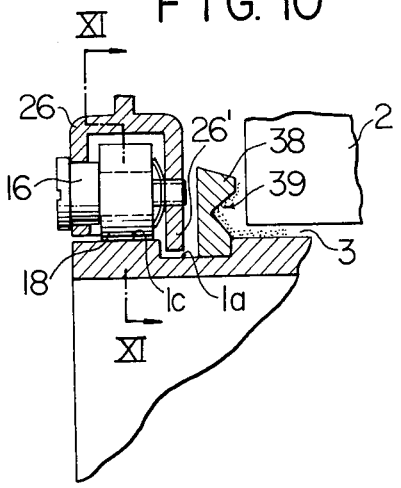
FIG. 10 is an enlarged sectional view of a main portion of the donor drum of FIG. 9.
Figure 11:
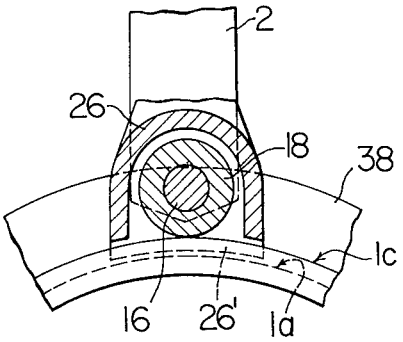
FIG. 11 is a section taken on line XI—XI in FIG. 10.

As shown in FIG. 9 through FIG. 11, a circular flange member 38 with a predetermined diameter is attached to the side of each effective image formation area 1*b* of the circular groove 1*a*. The circular flange member 38 is disposed between the effective image formation area 1*b* and the guide surface 1*c*, whereby both are sealed. Therefore, even if toner is scattered in the effective image formation area 1*b* of the donor drum 1, the circular flange member 38 prevents toner from scattering onto the contact area of the roller 18 and the guide surface 1*c*. In the case of this embodiment, the circular flange member 38 has a groove 39, whose section is V-shaped, on the end surface on the side of the effective image formation area 1*b*. The groove 39 serves to prevent toner in the effective image formation area 1b from moving to the guide surface 1c along the surface of the circular flange member 38 at the undercut portion of the groove 39.

Referring to FIG. 12 through FIG. 17, another group of embodiments of the present invention, in which the movement of toner from the effective image formation area 1b to the guide surface 1c is prevented, will now be explained.

Figure 12:
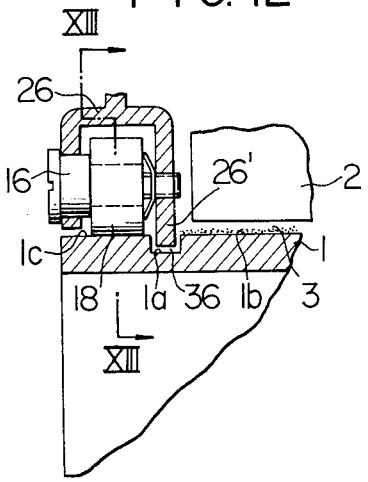
FIG. 12 is an enlarged sectional view of a main portion of an example of means for forming a labyrinth in the circular groove.
Figure 13:
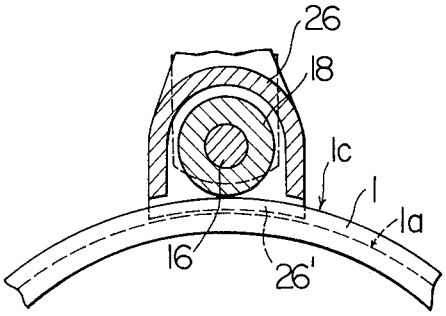
FIG. 13 is a section taken on line XIII-XIII

In FIGS. 12 and 13, the roller bracket 26 is shaped like a cap capable of covering the roller 18, and a skirt portion 26' on the side of the effective image formation area 1b is engaged with the circular groove 1a with a predetermined clearance therebetween, and a labyrinth 36 is formed between the circular groove 1a and the skirt portion 26' which serves as a labyrinth formation member.

By the above-mentioned construction, even if the toner in the effective image formation area 2b of the donor drum 1 is scattered and directed to the opposite end portions of the donor drum 1, the toner is prevented from entering the contact area of the roller 18 and the guide surface 1c by the roller bracket 26 and the labyrinth 38, whereby the contact area is kept clean and free from the toner, so that the clearance 3 can be maintained at a predetermined clearance value.

Figure 14:
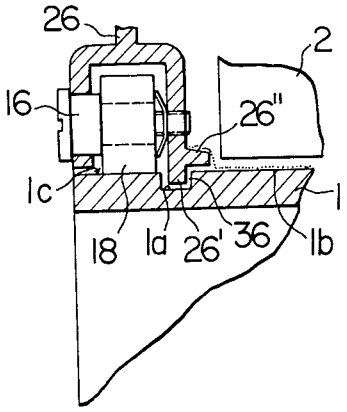
FIGS. 14, 15 and 16 are enlarged sectional views of the main portions of different examples of means for forming a labyrinth in the circular groove.

In the case of a further embodiment as shown in FIG. 14, the skirt portion 26' of the roller bracket 26 has a projected member 26' facing the outer peripheral surface of the effective image formation area 1b of the donor drum 1, with a predetermined small gap therebetween. In this case, the effective length of the labyrinth 36 formed between the roller bracket 26 and the donor drum 1 becomes longer, so that the entering of toner into the portion of the guide surface 1c is more securely prevented.

Figure 15:
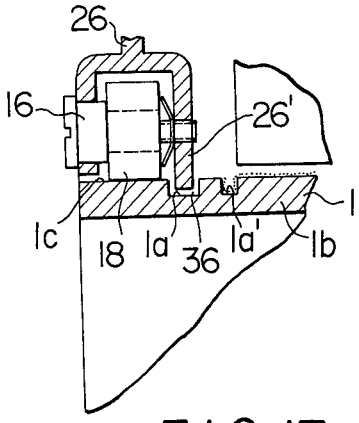

In the case of a further embodiment as shown in FIG. 15, one or more circular groove 1a ' is formed closer to the side of the effective image formation area 1b than the circular groove 1a with a space placed between the circular groove 1a and the circular groove 1'. In this case, in order that toner enters the portion of the guide surface 1c of the donor drum 1, the toner has to move across the circular groove 1a', which makes it very difficult for the toner to enter the portion of the guide surface 1c. Furthermore, toner dropped into the circular grooves 1a and 1a' is discharged therefrom by centrifugal force or under its own weight due to the rotation of the donor drum 1.

Figure 16:
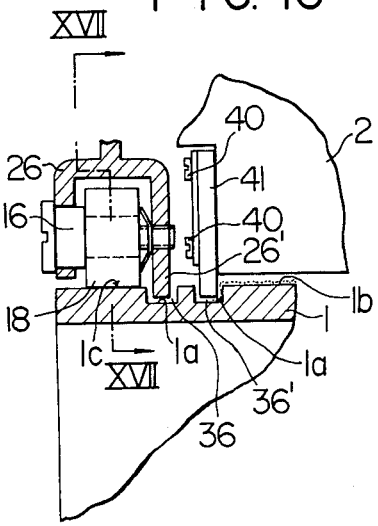
Figure 17:
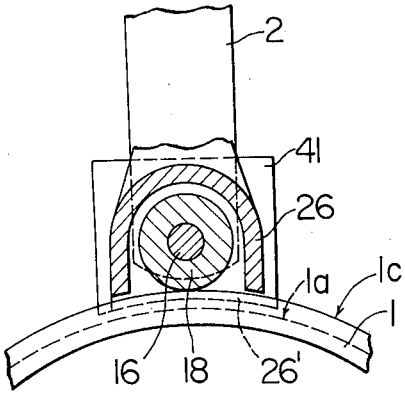
FIG. 17 is a section taken on line XVII-XVII in FIG. 16.

In the case of the embodiment as shown in FIGS. 16 and 17, an engagement member 41, which serves as the labyrinth formation member, is fixedly supported on the recording electrode 2 by a screw 40, and the engagment member 41 is fitted into the circular groove 1a' with a predetermined clearance therebetween, so that another labyrinth 36' is formed between the guide surface 1c and the donor drum 1. In the case of such embodiment, since the two labyrinths 36 and 36' are formed between the effective image formation area 1b of the donor drum 1 and the guide surface 1c, the entering of the toner into the portion of the guide surface 1c can be much more secure.

Figure 18:
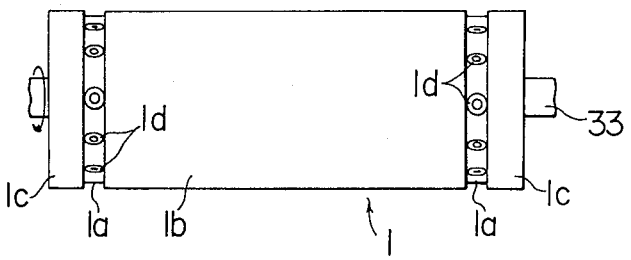
FIG. 18 is a front view of an example of a donor drum provided with toner discharge holes in the circular grooves.
Figure 19:
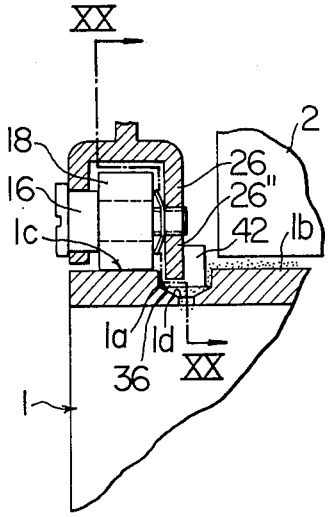
FIG. 19 is an enlarged section of the main portion of the donor drum in FIG. 18.
Figure 20:
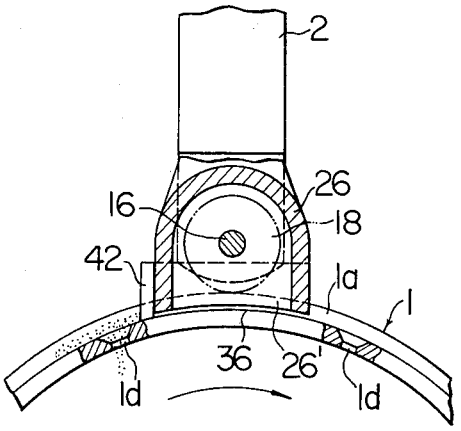
FIG. 20 is a section taken on line XX-XX in FIG. 19.

Referring to FIG. 18 through FIG. 20, a further embodiment of the present invention, which is capable of preventing toner from entering the portion of the guide surface 1c more securely, will be explained.

In FIGS. 18, 19 and 20, the donor drum 1 has a plurality of toner discharge holes 1d which are opened at the bottom surface of each of the circular grooves 1a. Each of the toner discharge holes 1d passes through the cylindrical donor drum 1 and the opening thereof directed to the circular groove 1a is tapered so as to open the full size of the circular groove 1a.

The roller bracket 26 is provided with a scraper plate 42 made of rubber or the like at a portion downstream in view of the rotating direction of the donor drum 1. The scraper plate 42 is engaged with the circular groove 1a so as to collect toner in the circular groove 1a.

By the above-mentioned construction, even if the toner in the effective image formation area 1b of the donor drum 1 is directed to enter the contact area of the guide surface 1c and the roller 18, such entering of the toner is prevented by the circular groove 1a and the labyrinth 26 formed in the portion of the circular groove 1a. The toner dropped into the circular groove 1a is collected by the scraper plate 42 and discharged out of the circular groove 1a through the toner discharge holes 1d. Accordingly, the contact portion between the guide surface 1c of the donor drum 1 and the roller can be always maintained clean and free from toner, whereby the clearance 3 can be always maintained at a predetermined clearance value.

In the embodiments are so far explained, the labyrinth is formed in the circular groove 1a, whereby he entering of toner into the guide surface 1c is prevented. In contrast with this, referring to FIG. 21 through 24, embodiments provided with means capable of removing toner which has already entered the portion of the guide surface 1c will now be explained.

Figure 21:
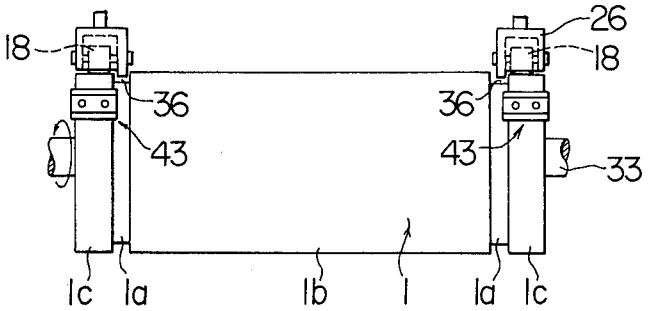
FIG. 21 is a front view of an example of a powder toner removing means provided on the guide surface of a donor drum.
Figure 22:
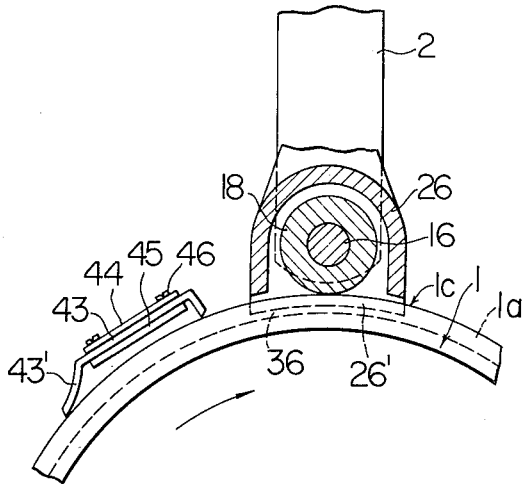
FIG. 22 is an enlarged sectional view of the main portion in FIG. 21.

In FIGS. 21 and 22, a scraper blade 43 is provided, which is positioned upstream of the contact portion of the roller 18 and the guide surface 1c in view of the rotating direction of the donor drum 1 and which is slidably in contact with the guide surface 1c. The scraper blade 43 can be made of rubber or similar material. The scraper blade 43 is held between two support plates 44 and 45 as shown in FIG. 22 and fixed thereto by a screw 46. Furthermore, the scraper blade 43 has an inclined surface 43' which is inclined against the rotating direction of the doner drum 1, and the scraped toner is guided by the inclined surface 43' and removed. The scraper blade 43 is supported by a stationary member (not shown) and is brought into pressure contact with the guide surface 1c with an appropriate pressure.

By the above-mentioned construction, even if the toner in the effective image formation area 1b is directed to enter the contact area of the guide surface 1c and the roller 18, such entry of the toner is prevented by the circular groove 1a and the labyrinth 36 formed in the portion of the circular groove 1a. Should the toner pass through the portion and then be deposited on the guide surface 1c, the toner is removed and scraped from the guide surface 1c by the scraper blade 43 before reaching the contact area of the guide surface 1c and the roller 18. Accordingly, the contact portion between the guide surface 1c of the donor drum 1 and the roller 18 can always be maintained clean and free from toner, whereby the clearance 3 can always be maintained at a predetermined clearance value.

Figure 23:
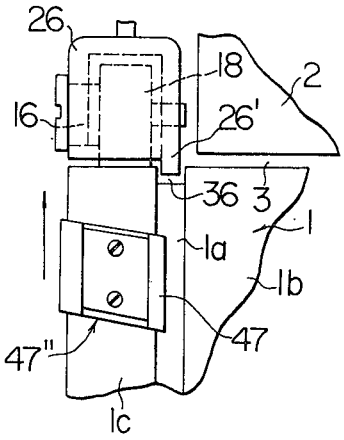
FIG. 23 is an enlarged front view of another example of the powder toner removing means.

In the embodiment in FIG. 23, a scraping edge 47" of the scraper blade 47 is inclined with respect to a generating line of the donor drum 1. This inclination direction is such that the side end portion of the donor drum 1 is positioned downstream of the rotating direction of the donor drum 1, deviated from the center side of the donor drum 1. Accordingly, in this case, the toner scraped by the scraper blade 47 is guided slantingly along the scraping edge 47″ and removed towards the side end portion of the donor drum 1, whereby it is prevented that toner remains in the contact portion between the donor drum 1 and the scraper blade 47.

Figure 24:
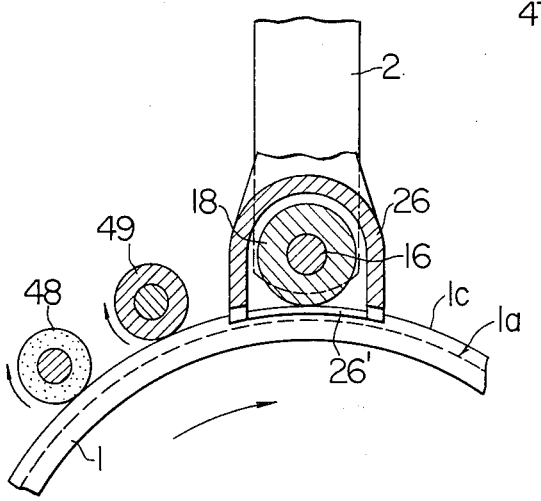
FIG. 24 is an enlarged front view of a further example of the powder toner removing means.

In the above-mentioned embodiment, toner deposited in the guide surface 1*c* is removed by the scraper blade 47. However, the present invention is not limited to this, but toner can be removed by use of the cleaning rollers 48 and 49 which are rotated in the direction of the arrows as shown in FIG. 24. In this case, the cleaning roller 48 can be made of rubber or foamed resin or the like and the cleaning roller 49 can contain a volatile liquid, such as alcohol and Isopar.

While the specific embodiments of the invention have been shown and described in detail to illustrate the application of the principles of the invention, it will be understood that the invention may be embodied otherwise without departing from such principle.

What is claimed is:

1. A small clearance retention apparatus for maintaining a small clearance, in the direction of a generating line of a cylindrical rotating member, between the outer peripheral surface of said cylindrical rotating member and a cooperating member to be spaced from said cylindrical rotating member by said small clearance, said apparatus comprising:

cooperating member support means for supporting said cooperating member to permit said cooperating member to move toward and away from the outer peripheral surface of said cylindrical rotating member;

pressure means for urging said cooperting member toward close proximity with the outer peripheral surface of said cylindrical rotating member;

a pair of rollers serving as spacers in contact with the opposite end portions, respectively, of said cylindrical rotating member;

a pair of spacer support means for supporting said rollers rotatably, part of said cooperating member being in contact with part of said spacer support means; and separate means to support said spacer support means.

2. A small clearance retention apparatus as claimed in claim 1, wherein said spacer support means include support shaft means for supporting said spacers rotatably thereon, and said cooperating member is in contact with part of said support shaft means.

3. A small clearance retention apparatus as claimed in claim 2, wherein a portion of said support shaft means, other than the portion thereof on which said spacers are supported, is in contact with said cooperating member.

4. A small clearance retention apparatus as claimed in claim 1, wherein said cooperating member comprises a contact portion with which part of said spacer support means is in contact.

5. A small clearance retention apparatus as claimed in claim 4, wherein said contact portion is plain and smooth.

6. A small clearance retention apparatus as claimed in claim 1 comprising spacer moving means to move said pair of rolled in a circumferential direction with respect to said cylindrical rotating member along the outer peripheral surface thereof, said pressure means urging said cooperating member substantially radially toward said cylindrical rotating member.

7. A small clearance retention apparatus as claimed in claim 6 wherein said spacer moving means comprises: a movement plate; an adjustment plate; spring means; and adjustment screw means.

8. A small clearance retention apparatus as claimed in claim 1 wherein said cooperating member support means comprises linear ball bearing apparatus.

9. A small clearance retention apparatus as claimed in claim 1, wherein the outer peripheral surface of said cylindrical rotating member is divided longitudinally into a central portion and guide portions on the opposite ends of said cylindrical rotating member, said spacers being in contact with said guide portions.

10. A small clearance retention apparatus as claimed in claim 9, wherein the surface layer of said guide portions is a hardened layer.

11. A small clearance retention apparatus as claimed in claim 9, comprising cleaning means in contact with the surface of said quide portions.

12. A small clearance retention apparatus as claimed in claim 11, wherein said cleaning means is a scraper blade.

13. A small clearance retention apparatus as claimed in claim 12, wherein said scraper blade is inclined with respect to a generating line of said cylindrical rotating member so that a scraping edge of said scraper is positioned upstream of the rotating direction of said cylindrical rotating member relative to the central portion of said cylindrical rotating member.

14. A small clearance retention apparatus as claimed in claim 11, wherein said cleaning means is a cleaning roller.

15. A small clearance retention apparatus as claimed in claim 14 comprising a plurality of said cleaning rollers.

16. A small clearance retention apparatus as claimed in claim 9 comprising a circular groove formed in the boundary portion between said central portion and said quide portions.

17. A small clearance retention apparatus as claimed in claim 16 comprising a circular flange attached to a central portion side of said circular groove.

18. A small clearance retention apparatus as claimed in claim 17 comprising a circular groove formed on the central portion side of said cylindrical rotating member of said circular flange.

19. A small clearance retention apparatus as claimed in claim 16 comprising a labyrinth formation member fitted into said circular groove so as to form a labyrinth.

20. A small clearance retention apparatus as claimed in claim 16 comprising a plurality of said circular grooves formed in the boundary portions between said central portion and the guide portions.

21. A small clearance retention apparatus as claimed in claim 20 comprising a labyrinth formation member fitted into any of said plurality of circular grooves.

22. A small clearance retention apparatus as claimed in claim 21 comprising a plurality of said labyrinth formation members, at least one of said labyrinth formation members being attached to said cooperating member.

23. A small clearance retention apparatus as claimed in claim 16 comprising discharge hole means through said cylindrical rotating member, said discharge hole means intersecting said circular groove.

24. A small clearance retention apparatus as claimed in claim 23 comprising a scraper plate in contact with the bottom of said circular groove provided with said discharge hole means.

25. A small clearance retention apparatus as claimed in claim 23, wherein the opening end of each of said discharge holes is tapered to the full width of said circular groove.

26. A small clearance retention apparatus as claimed in claim 9, wherein said guide portions comprise hard sleeves attached to the opposite end portions of said cylindrical rotating member said hard sleeves comprising material this is different from said cylindrical rotating member.

27. A small clearance retention apparatus as claimed in claim 1 comprising, in addition, a stationary member, said pressure means comprising spring means disposed between said cooperating member and said stationary member.

28. A small clearance retention apparatus as claimed in claim 1, wherein said separate means includes a bracket and said pair of spacer support means comprises pair of support shafts to support said rollers rotatably.

29. A small clearance retention apparatus as claimed in claim 28, wherein said bracket is shaped like a cap capable of covering said spacers.

30. A small clearance retention apparatus as claimed in claim 28, wherein said cylindrical rotating member includes a circular groove between at least one opposite end portion of said cylindrical rotating member and a central portion thereof and, a skirt portion of said bracket is fitted into said circular groove.

31. A small clearance retention apparatus as claimed in claim 30 comprising a projecting member disposed in said skirt portion, said skirt portion being spaced from the surface of said central portion of said cylindrical rotating member.

32. A small clearance retention apparatus for maintaining a small clearance, in the direction parallel to a generating line of a donor drum bearing toner on the outer peripheral surface thereof, between the outer peripheral surface of said drum and a recording electrode disposed in close proximity with said drum with said small clearance with respect to said drum, said apparatus comprising:

support means for supporting said recording electrode movably in the direction toward and away from contact with the outer peripheral surface of said donor drum;

pressure application means for giving said recording electrode a movement bias toward the outer peripheral surface of said donor drum;

a pair of rollers, part of each of which is in contact with the peripheral surface at the end portions of said donor drum;

a pair of roller support means for supporting said rollers rotatably, part of said recording electrode being in contact with part of said roller support means; and separate means supporting said roller support means separately from said drum and said recording electrode.

* * * * *